United States Patent [19]

Carden

[11] Patent Number: 4,669,728

[45] Date of Patent: Jun. 2, 1987

[54] ELECTRONIC DICE GAME

[76] Inventor: Patrick M. Carden, 216 D N. Placentia Ave., Placentia, Calif. 92670

[21] Appl. No.: 798,812

[22] Filed: Nov. 18, 1985

[51] Int. Cl.[4] ..... A63B 71/00; A63F 7/22

[52] U.S. Cl. ..... 273/138 A; 273/238; 320/2

[58] Field of Search ..... 273/138 A, 146, 238, 273/239

[56] References Cited

U.S. PATENT DOCUMENTS 2,619,349 11/1952 Abrahamson ..... 273/238
3,843,132 10/1974 Ferguson ..... 273/238
4,545,582 10/1985 Andrews ..... 273/239 X

FOREIGN PATENT DOCUMENTS 3238373 4/1984 Fed. Rep. of Germany ... 273/138 A

OTHER PUBLICATIONS

Brown, G., "Numbers Without Tears", *Practical Wireless,* Jul. 1979, vol. 55, No. 7, pp. 34–37, 60.

*Primary Examiner*—Richard C. Pinkham
*Assistant Examiner*—Stuart W. Rose
*Attorney, Agent, or Firm*—William L. Chapin

[57] ABSTRACT

An electronic dice game apparatus includes an internally powered electronic playing piece containing a random number generator which drives a visual display within the playing piece for displaying one or more numbers or dot patterns corresponding to the dots displayed by one or two dice which have been rolled. A magnetic field sensor within the playing piece is responsive to a magnetic field-producing element within a base forming part of the apparatus in causing a high-frequency oscillator within the playing piece to stop, causing a counter connected to the output of the oscillator to transfer random numbers based upon the accumulated count to the display input drive lines, and causing the display, which is dark in the absence of a magnetic field energizing the playing piece sensor, to display the numbers.

12 Claims, 9 Drawing Figures

ELECTRONIC DICE GAME

BACKGROUND OF THE INVENTION

1. Field of the Invention

This invention relates to electronic devices which simulate the operation of one or more dice being rolled for use in games of chance. More particularly, the invention relates to self-contained dice simulating electronic devices incorporating in a single unit number generating and display functions.

2. Description of Background Art

The concept of electronically simulating the rolling of one or more dice for producing numbers upon which games of chance may be based is not new. For example, Wiencek, in U.S. Pat. No. 4,431,189, issued Feb. 14, 1984, discloses an electronic random die having a selectable number of sides. The die roll is accomplished by counting through the dice progression at a high speed. When the counting is stopped, the last die progression is exhibited. The length of the counting time, and therefore the randomness, is determined by the operator and the high speed clock.

Murry, in U.S. Pat. No. 4,506,890, issued Mar. 26, 1985, discloses an electronic dice game employing a random number generator 150, which is a 555 integrated circuit timer chip configured as an astable multivibrator. Timer chip 150 produces a series of pulses 151 as long as the roll switch 31 supplies Vcc voltage to the 555 timers that are used. The frequency of pulse train 151 is selected to provide a realistic appearance or rolling dice on the seven LEDS used to represent the PIPS of each die.

Frechou, in French Pat. No. 2,425,681, issued Dec. 7, 1979 discloses an electronic random number generator for games of chance. The number generator uses a high frequency oscillator (1) whose output signal is coupled via push button switch (8) to two binary counters (2). The counter outputs are decoded by decoders (3) for display on indicators (4). The counters are switchable by switch (5) to provide two single digit dice or a single die with up to one hundred numbers.

The instruction manual for an electronic digital dice kit marketed by Radio Shack, Catalog #277.131 discloses an electronic digital dice game employing an oscillator which drives a counter and begins running when the Roll switch is pressed. When the oscillator is stopped, a random count is contained within the counter and displayed via LEDs representing the spots on a die.

All of the prior art references cited above utilize a "random" number generator which drives a visual display representing the number on the upper face of an imaginary die that has been "rolled" by operation of the device containing the random number generator. Typically, the random number generator outputs a sequence of numbers to the display device as long as an operate or "roll" switch is activated. When the game participant ceases activating the roll switch, an unpredictable or "random" number appears on the display.

Most of the "random" number generators disclosed in the prior art employ a counter which produces a cyclically repetitive sequence of numbers to be displayed on the game display device. Thus, the sequence of numbers is not truly random. However, the counter operates at such a high frequency that an operator could not feasibly stop the counter at a precise count. Thus, the operator can control the approximate duration of operation of the counter, i.e., the operating time of the "roll", but not the number ultimately displayed.

The present invention employs a pseudo-random number generator of the type described above. However, the electronic dice game according to the present invention utilizes novel means for randomly producing dice numbers which provides greater realism and player interest.

OBJECTS OF THE INVENTION

An object of the present invention is to provide a device which is capable of producing and displaying random numbers for use in games of chance.

Another object of the invention is to provide a random number generating gaming device which may be operated merely by picking up and setting down the device on a base forming part of the device.

Another object of the device is to provide a random number generating device which may be remotely enabled by signals transmitted to a base on which the device is placed.

Another object of the device is to provide a random number generating device which may be activated only when placed correctly on a special base, and which will activate an alarm if moved from that placement prior to a particular time.

Various other objects and advantages of the present invention, and its most novel features, will become apparent to those skilled in the art by reading the accompanying description of the invention.

It is to be understood that, although the invention disclosed herein is fully capable of achieving the objects and providing the advantages described, the description of the invention contained herein is merely illustrative of the preferred embodiments. Accordingly I do not intend that the scope of my exclusive rights and privileges in the invention be limited to the details of the embodiments described. I do intend that reasonable equivalents, adaptations and modifications of the various embodiments and alternate forms of the present invention which are described herein be included within the scope of this invention as particularly pointed out by the appended claims.

SUMMARY OF THE INVENTION

Briefly stated, the present invention comprehends an electronic game which generates and displays random numbers representing the numbers displayed on one or more dice. The game includes a playing piece and a base. The playing piece includes an internal electronic number generator which drives a visual display, a sensing element which, when activated, is effective in stopping the number generator and causing a fixed number to be displayed, and an internal battery for powering the components of the playing piece.

The game, according to the present invention, also includes a base effective in activating the sensing mechanism of the playing piece.

In the preferred embodiment, the number generator in the playing piece includes a high frequency electronic oscillator which drives an electronic counter. The output port of the electronic counter is connected to the input port of a display driver, which in turn drives a visual number display device, such as a seven-segment light emitting diode (LED) display. Fluorescent, liquid crystal display (LCD), or plasma display devices may be used in place of the LED display.

To play the game, the playing piece is initially removed from the base. The power switch in the playing piece is then turned on, applying battery power to the number generator. This produces a rapidly changing sequence of numbers in the electronic counter. During this time, the display device is not energized.

The playing piece includes a magnetic switch located inside the device and just above its bottom surface. When the playing piece is placed in the correct position on the base, a magnet located within the base activates the magnetic switch within the playing piece.

Activating the magnetic switch causes an electrical signal to be applied to the oscillator, which stops the oscillator and also energizes the display device. This causes the counter to stop and display the last number it had counted to before being disabled. Since the oscillator operates at such a high frequency, it is not possible for the player to stop the counter at a desired number by placing the playing piece on the base at a precise instant. Thus, the number displayed on the playing piece display device is controlled by the player, but in an unpredictable, random way.

DETAILED DESCRIPTION OF THE INVENTION

Figure 1:
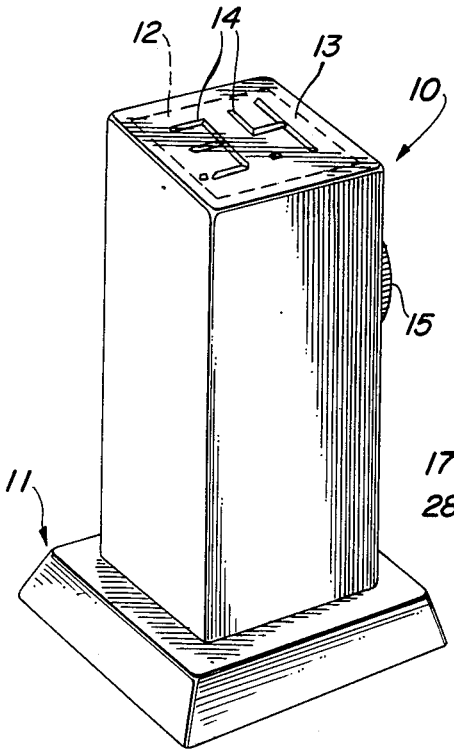
FIG. 1 is a perspective view of the electronic dice game according to the present invention.
Figure 2:
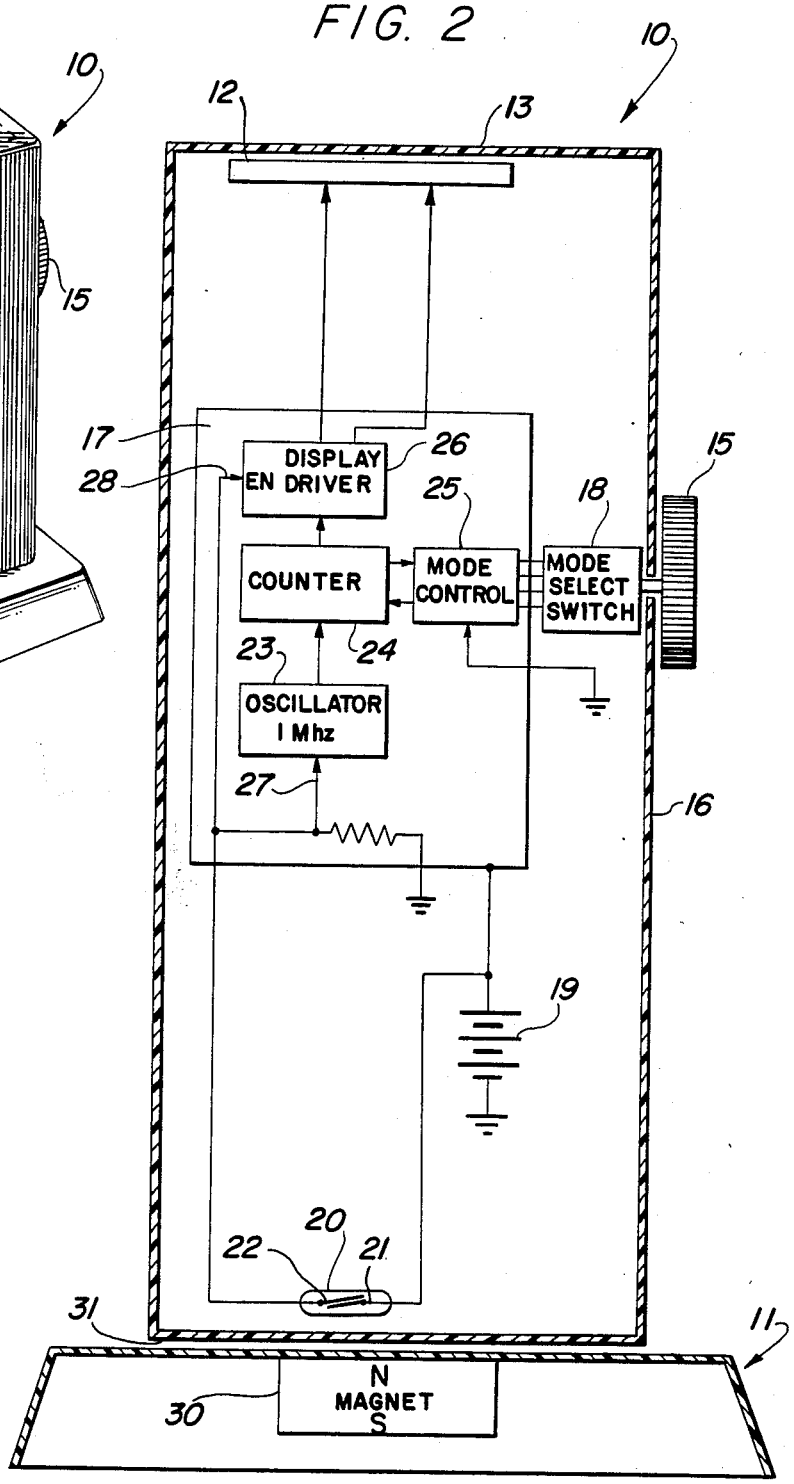
FIG. 2 is a composite block diagram and partially sectional front elevation view of the apparatus of FIG. 1.

Referring now to FIGS. 1 and 2, an electronic dice game according to the present invention is shown to include two separate components: (1) a playing piece 10 having the shape of a hollow rectangular solid and (2) a generally tabular-shaped base 11. Playing piece 10 has vertically elongated rectangular side walls and more nearly square cross-section top cover and base panels. Playing piece 10 is fabricated from a nonferromagnetic material, preferably plastic.

As shown in FIG. 1, playing piece 10 includes a display unit 12 mounted below the top cover panel 13 of the playing piece. Display unit 12 preferably contains two adjacent seven-segment light emitting diode (LED) arrays 14. Top cover panel 13 is translucent, permitting the numbers displayed by energizing the LED segments to be viewed through the top panel. FIG. 1 also shows a mode control switch knob 15 mounted on the right side wall 16 of playing piece 10.

Referring now to FIG. 2, playing piece 10 is seen to contain an electronic unit 17, a mode select switch 18, a battery 19 and a magnetic reed switch 20.

Electronic unit 17 is comprised largely of interconnected low-power integrated circuits, such as CMOS logic devices, and associated discrete passive components. Included within electronic unit 17 is a free running oscillator 23 operating at a frequency of approximately 1 megahertz. The output terminal of oscillator 23 is connected to the input terminal of a two-digit binary coded decimal (BCD) counter 24. Counter 24 has a modulo which may be varied by input signal levels produced by mode control module 25 and selected by mode control switch 18 connected to the input terminals of the mode control module.

Count output lines from counter 24 are connected to the input terminals of display driver 26. Display driver 26 decodes the BCD count input from counter 24 into the proper drive signals for dual seven-segment display unit 12. Thus, the function of display driver 26 is to convert a BCD number accumulated in counter 24 into a pattern of drive signals for the elements of display unit 12. In the basic embodiment of the invention, the drive signals energize the appropriate elements of two seven-segment LED arrays 14 to produce a one-digit or two-digit decimal number.

As shown in FIG. 2, playing piece 10 includes a magnetic reed switch 20. Input terminal 21 of reed switch 20 is connected to the positive terminal of a battery 19 contained inside playing piece 10. Output terminal 22 of reed switch 20 is connected to a disable input terminal 27 of oscillator 23, and to an enable terminal 28 of display driver 26.

Reed switch 20 is a normally open switch. With the contacts of reed switch 20 open, disable input terminal 27 of oscillator 23 is maintained at a low voltage level by a pulldown resistor 29 connected to ground. This allows oscillator 23 to run freely, permitting a rapidly changing count signal to be outputted by counter 24 to display driver 26. However, with enable input terminal 28 of display driver 26 pulled low as a result of the contacts of reed switch 20 being open, no signals are outputting to display unit 12. Thus, LED arrays 14 are dark at this time.

When reed switch 20 is placed in the vicinity of a relatively strong magnetic field, the contacts of the reed switch close. Closing the contacts of reed switch 20 causes output terminal 22 to rise to a positive voltage. This voltage rise disables oscillator 23, and enables display driver 26, thus permitting the count accumulated in counter 24 up to the time oscillator 23 is disabled to be decoded by display driver 26 and displayed on the two LED arrays 14.

A permanent magnet 30 concealed within base 11 is used to activate magnetic reed switch 20 by setting base panel 31 of playing piece 10 down on the upper surface of base 11.

To use the electronic dice game according to the present invention, playing piece 10 is lifted off of base 11, causing display unit 12 to go dark as has been described above. While reed switch 20 is open as a result of being removed from the magnetic field produced by permanent magnet 30, the count accumulating in counter 24 changes at a one-megahertz rate. Thus, when the playing piece is set back down on the base, disabling the oscillator and displaying the count, the number displayed by display unit 12 is a random number, since the manual action of placing the piece on the base is asynchronous with the oscillation of oscillator 23. Furthermore, the extremely rapid rate of change of the count makes it physically impossible for the player to control the number ultimately displayed by attempting to control the time interval for which the playing piece is removed from the base. Thus, the present invention provides a novel and efficient means for generating and displaying a random number merely by removing the playing piece 10 from base 11, and returning it to its resting place on the base.

Mode select switch 18 permits various combinations of random number sequences to be displayed on display unit 12. For example, one mode select switch setting permits a single one of LED arrays 14 to display numbers ranging from 1 to 6, representing the roll of a single conventional die. Another mode select switch setting permits each of the two LED arrays to display number sequences ranging from 1 to 6, representing the roll of two dice. For those applications in which the game, according to the present invention, is to be used only to simulate the roll of conventional dice, both of the seven-segment LED arrays 14 may be replaced by a group of LEDs arrayed in the same order as the six distinct dot patterns on the six faces of a die.

Figure 3:
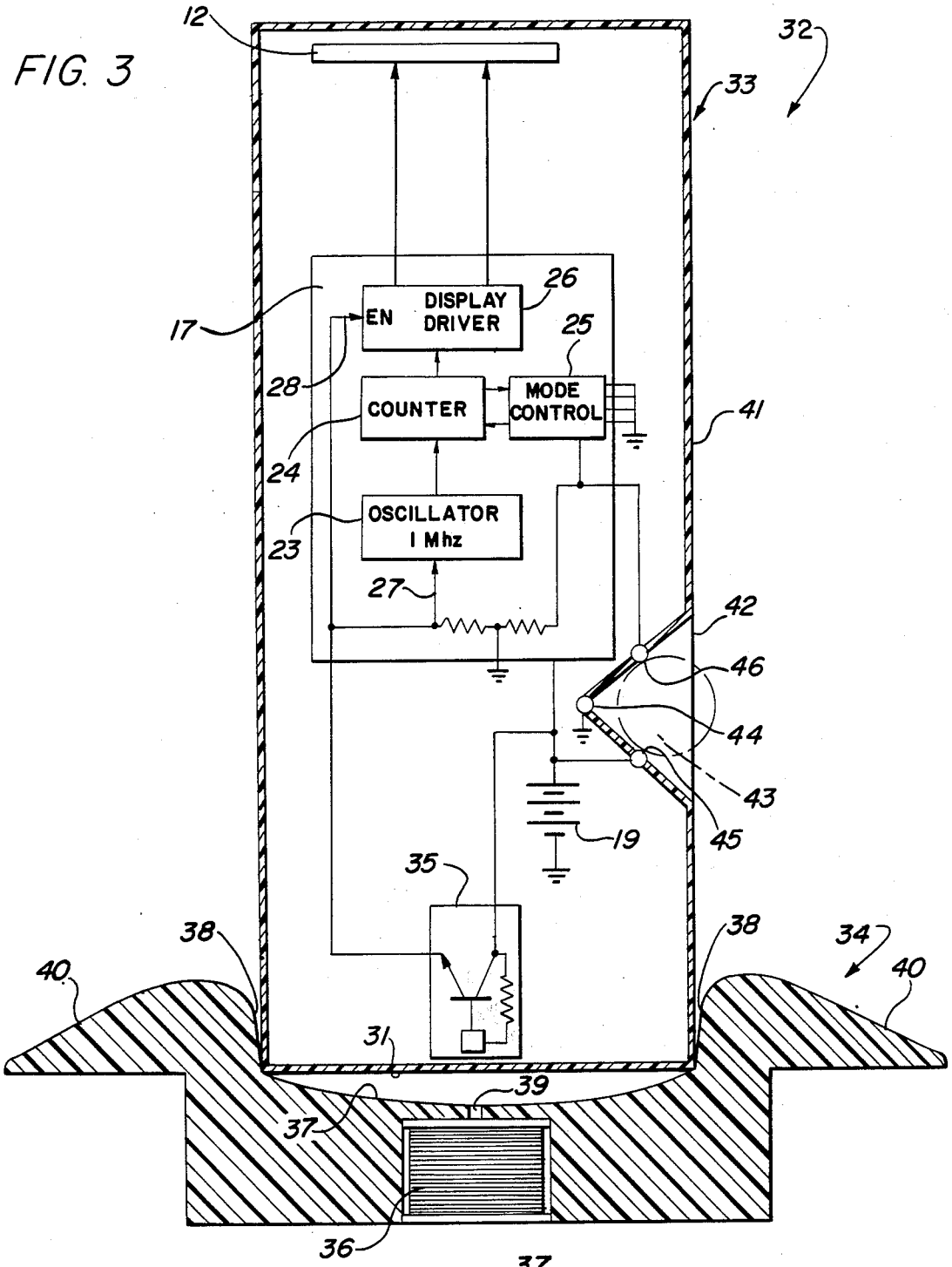
FIG. 3 is a composite block diagram and partially sectional front elevation view of a second embodiment of the invention.

For games such a "Dungeons and Dragons", mode select switch 18 may be used to select other possible roll sequences, such as:

one to four (Displayed on one or both LED arrays)
one to six (Displayed on one or both LED arrays)
one to eight
one to ten
one to twelve
one to twenty
zero to ninety-nine FIG. 3 illustrates a second embodiment 32 of the electronic dice game according to the present apparatus. This second embodiment is particularly well adapted to use in casinos.

As shown in FIG. 3, the second embodiment 32 of the dice game includes a playing piece 33 which is a modification of playing piece 10 of the basic embodiment of the invention shown in FIGS. 1 and 2. The second embodiment also includes a tray 34 which is a modification of the base 11 shown in FIGS. 1 and 2.

As shown in FIG. 3, modified playing piece 33 preferably uses a Hall-effect switch element 35 in place of magnetic reed switch 20. Hall-effect switch element 35 has a high impedance when outside a region of strong magnetic flux, and a low impedance when in a strong magnetic field. Operationally, Hall-effect switch element 35 performs a function identical to that of magnetic reed switch 20; namely, to enable operation of oscillator 23 and disable operation of display driver 26 when playing piece 33 is removed from a strong magnetic field, and vice versa when the playing piece is placed in a strong magnetic field.

Figure 4:
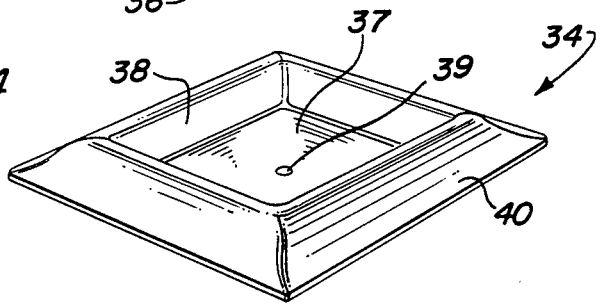
FIG. 4 is a perspective view of the support tray forming part of the apparatus shown in FIG. 3.

As shown in FIGS. 3 and 4, a magnetic field required to activate Hall-effect switch element 35 may be provided by an electromagnet 36 beneath the upper surface of tray 34. As shown in the Figures, tray 34 has a generally square transverse cross section center part or base 37 with side walls 38 that arise steeply from the base. The spacing between side walls 38 provides a snug fit for insertion from above of playing piece 33. Base 37 has a concave upper surface and a vertically disposed drain hole 39 through the center of the base to permit liquids inadvertently spilled into the tray to drain out beneath the tray. Electromagnet 36 or, alternatively, a permanent magnet 30 is positioned underneath base 37, and is effective in activating Hall-effect switch element 35 only when playing piece 33 has been inserted properly between side walls 38 onto base 37. The outer surfaces 40 of side walls 38 slope gently down to the surface on which the tray 34 is positioned. This gentle slope permits game chips to slide easily over the tray when playing piece 33 is removed from tray 34.

As shown in FIG. 3, right side wall 41 of modified playing piece 33 contains an elongated rectangular slot 42 opening into a triangular transverse cross-section cavity 43. The transverse cross-sectional shape of cavity 43 is that of an isosceles triangle with its base congruent with the long axis of slot 42. Three generally spherical electrical contacts made of metal or other conducting material protrude through the walls of cavity 43 and extend partially into the cavity. Contact 44, designated the ground contact, is located at the apex of triangular cavity 43. A second contact 45 designated the battery contact, is located on the lower side of cavity 43. The third contact 46, designated the test mode contact, is located on the upper side wall of cavity 43, in vertical alignment with battery contact 45.

Ground contact 44 is electrically connected to the ground terminal of battery 19, and battery contact 45 is electrically connected to the positive terminal of the battery. Test mode contact 46 is electrically connected to an input terminal of mode control module 25.

One function of cavity 43 and its associated elements is to provide means for testing the playing piece 33. This is accomplished by inserting a coin into slot 42 and pushing it sufficiently far in to simultaneously contact battery contact 45 and test mode contact 46. This causes a positive D.C. signal level to be applied to the input terminal of mode control module 25, which terminal is connected to test mode contact 46. The mode control module then commands electronic unit 17 to enter a self-test mode. The self-test mode includes a sequential display of each possible number of display unit 12 at a rate sufficiently slow to verify that each number is correctly displayed.

A second function of cavity 43 and its associated elements is to provide access to the terminals of battery 19 for the purpose of recharging the battery.

Figure 5:
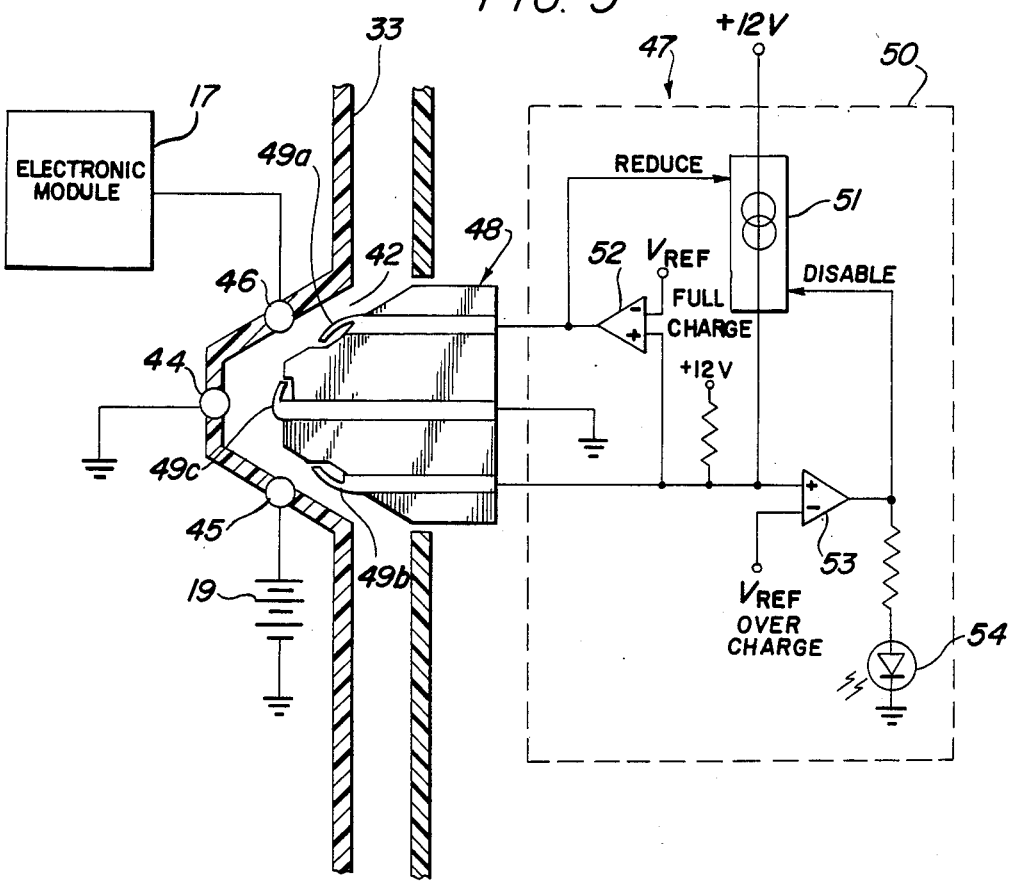
FIG. 5 is a fragmentary, partially sectional front elevation view and block diagram of a charging unit adapted to interface with the apparatus of FIG. 3.

As shown in FIG. 5, battery charger unit 47 includes a generally triangular shaped printed circuit board extension 48 adapted for insertion into slot 42 of modified playing piece 33. Curved metal fingers **49*a* and 49*b* in the upper and lower sides, respectively, of extension 48, and 49*c* at its apex, are adapted to conductively contact, respectively; test mode contact 46, battery contact 45, and ground contact 44. Printed circuit board extention 48 is preferably made from a durable insulating sheet such as fiberglass reinforced epoxy. Metal fingers 49** are preferably fabricated from a resilient non-oxidizing metal such as gold plated copper or phosphor bronze.

As shown in FIG. 5, battery charger unit 47 includes an electronics module 50 which is electrically connected to an external twelve-volt power source, and to curved metal finger contacts 49 on circuit board extension 48. Electronics module 50 includes a constant current source 51 which provides a constant current of the proper magnitude to the positive terminal of battery 19.

A first voltage comparator 52, referred to as the full-charge comparator, has a reference input terminal connected to a first voltage reference source, and a second input terminal connected to the positive terminal of battery 19. When the battery voltage reaches the full-charge reference level, a positive output level from comparator 52, which is connected to a control input terminal of constant current source 51, reduces the charging current level. The positive level of the output terminal of comparator 52, which is also connected to test mode contact 49*a*, initiates a test mode indicating that the battery is fully charged.

If the battery charger unit 47 is left connected to modified playing piece 33 for a substantial period of time after battery 19 has been fully charged, it is possible for the battery to become overcharged, reducing its useful life. To prevent this from happening, electronics module 50 includes a second voltage comparator 53, referred to as the over-charge comparator.

If the battery voltage level of the comparator input terminal of over-charge voltage comparator 53 exceeds the over-charge reference voltage level at the reference input terminal of the comparator, the voltage level at the output terminal of the comparator makes a positive transition. Since the output terminal of comparator 53 is connected to the disable input terminal of constant current source 51, that positive transition will turn off the constant current source. Also, a positive level at the output terminal of over-charge comparator 53 powers over-charge indicator LED 54. The current drain on battery 19 caused by energization of display LEDs 15 during the test mode operation of playing piece electronics unit 17 causes the excess charge on battery 19 to bleed off.

Figure 6:
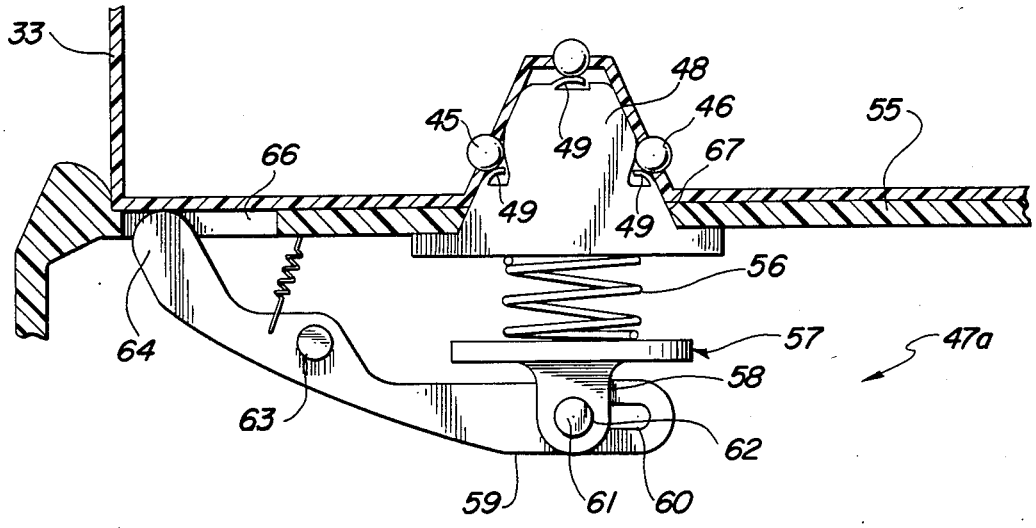
FIG. 6 is a fragmentary, partially sectional front elevation view of a modification of the charging unit shown in FIG. 5.

FIG. 6 illustrates a modification of the battery charger unit 47 shown in FIG. 5. In the modified battery charger unit 47*a*, printed circuit board probe extension 48 is normally retracted behind the surface of side wall 55 of the modified charger unit. The inner surface of probe extension 48 is fastened to one end of a weak compression spring 56, the other end of which spring is fastened to a circular outline base plate 57. Base plate 57 has a pair of parallel downward depending flanges 58 that form a clevis. Flanges 58 slidably support between them an elognated, flat lever 59 having a longitudinal perforation 60 near one longitudinal end of the lever. Flanges 58 are secured to lever 59 by means of pin 61 passing through registered apertures 62 in flanges 58, and through perforation 60.

Lever 59 is pivotably mounted to the modified charger unit by pivot pin 63. The longitudinal end 64 of lever 59 on the opposite side of pivot pin 63 from the end of the lever containing perforation 60 has an arcuate outline. Curved end 64 of lever 59 is normally biased by tension spring 65 to extend outward through an aperture 66 of side wall 55 of the charger unit. With curved end 64 of lever 59 biased to a protruding position, probe extension 48 attached to the opposite end of lever 59 is biased to a retracted position behind aperture 67. In this retracted position, the probe extension 48 is protected from potentially damaging contact with external objects. However, when playing piece 33 is placed down on side wall 55 of the modified charger unit, curved end 64 of lever 59 is depressed downward to a position flush with the side wall. This downward movement in turn forces the slotted end of lever 59 to move upward, pushing probe extension 48 out through aperture 67 in side wall 55, and into cavity 43 in playing piece 33. Compression spring 56 spanning the distance between base plate 57, fastened to the slotted end of lever 59, and the inner surface of probe extension 48 assures firm, resilient contacting of metal fingers 47 of the probe extension with playing piece contacts within cavity 43.

Figure 7:
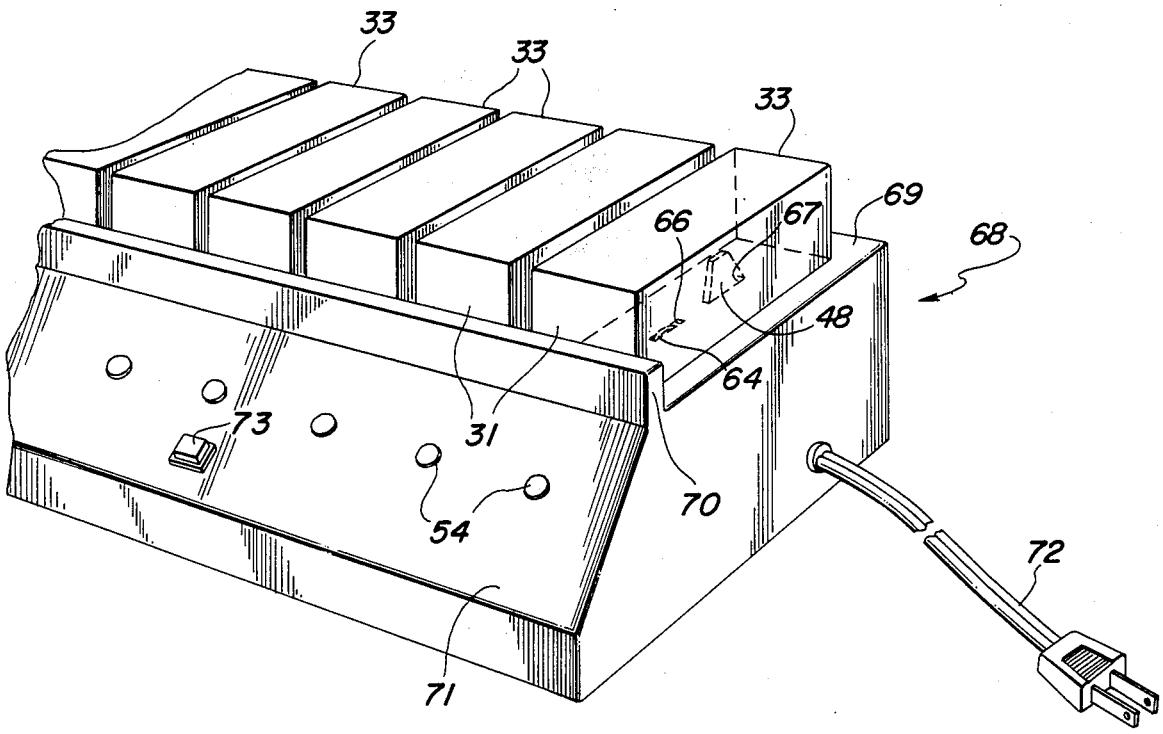
FIG. 7 is a perspective view of a charging console incorporating charging units of the type shown in FIG. 6.

As shown in FIG. 7, a plurality of modified battery charger units 47*a* are preferably integrated into a console 68 for simultaneously recharging the batteries 19 of several modified playing pieces 33.

As shown in FIG. 7, console 68 is a generally box-shaped enclosure having a downward and forward sloping top panel 69 terminating in a laterally disposed rib 70. Top panel 69 contains a plurality of laterally disposed aperture pairs 67 and 66 for probe extensions 48 and lever ends 64, as shown in FIG. 6. Beneath each aperture pair inside console 69 is located a modified charger unit 47*a*. Each charger unit 47*a* includes a retractable probe mechanism as shown in FIG. 6 and described above. Each probe mechanism is electrically connected to a charger circuit of the type shown in FIG. 5, and each charger circuit is connected to a separate overcharge indicator lamp 54 mounted on the front panel 70 of the console 68. Each charger circuit within console 68 is powered by an external source of electrical power coupled to the console by means of power cord 72. A power on indicator lamp 73 located on front panel 71 of the console 68 indicates when power is applied to the console. Thus, console 68 provides a convenient means for simultaneously recharging the batteries within a plurality of modified playing pieces 33 merely by placing the pieces down on top panel 69 of the console, with the base panel 31 of each playing piece resting on the inside edge of rib 70.

Figure 8:
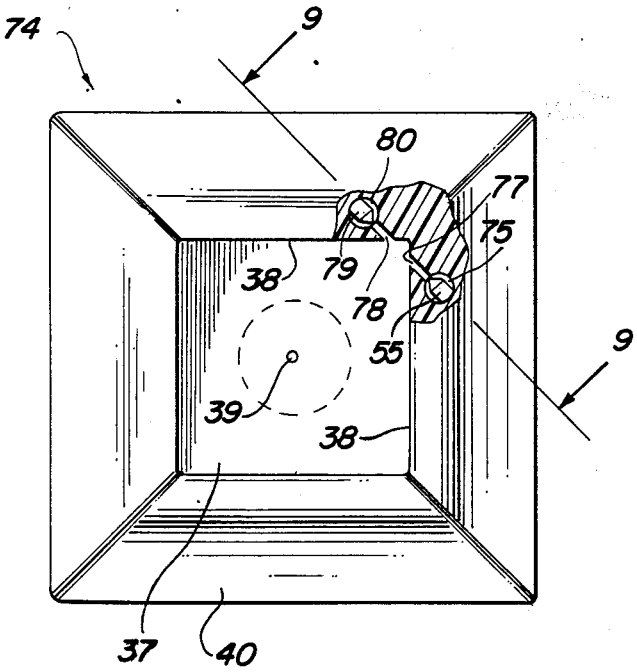
FIG. 8 is an upper plan view of an alternate embodiment of a support tray used with the apparatus of FIG. 3.
Figure 9:
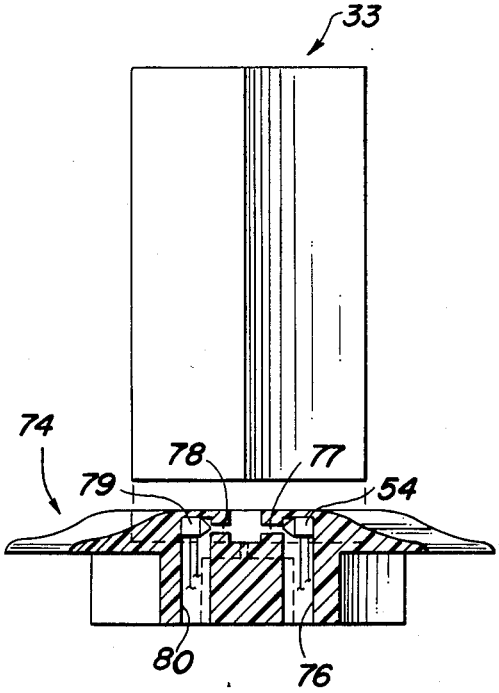
FIG. 9 is a sectional view of the structure shown in FIG. 7, taken along line 8—8.

FIGS. 8 and 9 illustrate a modification 74 of tray 34 shown in FIGS. 3 and 4. As shown in FIGS. 8 and 9, modified tray 74 includes a "light" emitting diode (LED) 75 which preferably emits invisible, infrared light. Infrared LED 75 is contained in a cavity 76 which extends upwards from the base of tray 74 to a point beneath the upper surface of side wall 38 of the tray. LED 75 is positioned near an intersecting corner of side walls 38 of base 37.

The optical axis of LED 75 is aligned to emit infrared energy horizontally and perpendicularly to an adjacent diagonal of square base 37 of tray 74, out through a small aperture 77 in the inner surface of side wall 38. Infrared energy exiting aperture 77 enters an aperture 78 through the inner surface of the side wall adjacent to the one containing aperture 77. Infrared energy entering through aperture 78 falls on the active surface of photodetector 79, positioned behind aperture 78 with its optical axis in alignment with the optical axis of infrared LED 75. Infrared photodetector 79 is contained in a cavity 80 similar to cavity 76, and in parallel alignment therewith.

The cooperative function of infrared LED 75 and photodetector 79 is to detect proper placement of modified playing piece 33 on tray 74. The detection signal produced by photodetector 79 may be used to activate electromagnet 36 in tray 74, thereby ending the simulated dice roll and causing display unit 12 to indicate the number obtained by the roll. Also, removal of playing piece 33 can produce a signal which may be used to activate an alarm buzzer or light, warning of an unauthorized removal of a playing piece before the end of play.

What is claimed is:

1. An electronic dice game comprising:

(a) a random number generator comprising (i) a high frequency oscillator, (ii) a counter connected to the output of said oscillator (iii) a display driver connected to the output count lines of said counter and having means for decoding said count and producing drive signals corresponding to said count, (b) a visual display device coupled to the output port of said display driver for displaying numbers generated by said random number generator, (c) electrical power storage means, (d) means for establishing an external magnetic field, said establishing means not connected to said electrical power storage means, (e) a sensor means responsive to said external magnetic field for energizing operation of said random number generator in the absence of said field and for stopping operation of said random number generator and displaying a fixed number in the presence of said field.

2. The apparatus of claim 1 wherein said sensor means includes a magnetic reed switch element.

3. The apparatus of claim 1 wherein said sensor means includes a Hall-effect device.

4. The apparatus of claim 1 wherein the modulo of said counter is variable under external control, thereby permitting control of the range of numbers displayable by said apparatus.

5. The apparatus of claim 1 further comprising a mode select module having an input terminal responsive to an external mode command signal in causing said random number generator to sequentially display each permitted number combination on said display device at a rate sufficiently slow for verification of proper operation of said apparatus.

6. The apparatus of claim 5 further comprising an enclosure for the internal elements of said apparatus, said enclosure having in one of its walls a thin, uniform thickness rectangular slot, said slot opening into a triangular transverse cross-section cavity, said cavity having a first electrical contact on one wall of said cavity, and a second electrical contact on a second wall of said cavity at the same altitude as said first electrical contact, said first electrical contact being electrically connected, to a source terminal of said electrical power storage means, and said second electrical terminal being electrically connected to said mode select module input terminal, whereby inserting a circular metal coin into said slot sufficiently far to simultaneously contact said first and second electrical contacts initiates verification of proper operation of said apparatus.

7. The apparatus of claim 6 further comprising a third electrical contact extending into said cavity from the vertex of said cavity, said third electrical contact being electrically connected to a return terminal of said electrical power storage means, whereby inserting a thin, generally triangular cross section insulating body having a source terminal protruding outward from a side of said body and a return terminal protruding outward from the vertex of said body permits simultaneously contacting said source and return terminals of said electrical power storage means, thereby permitting recharging of said electrical power storage means from an external source of electrical power.

8. The apparatus of claim 7 further comprising a charger unit adapted to recharge said electrical energy storage means in said electronic dice game, said charger having a panel having a surface adapted to contacting said wall of said enclosure containing said opening, and said charger having a probe comprising a thin, generally triangular cross section insulating body having curved electrical contacts adapted to make separate electrical connections with said electrical energy storage means source and return terminals within said cavity in said enclosure, said curved electrical contacts being electrically connected to an electrical power source, said probe being normally biased to a retracted position through a first aperture through said panel beneath the surface of said panel, and said probe being coupled to a lever normally biased to a protruding position through a second aperture through said panel to a position above the surface of said panel, whereby placing said wall of said enclosure on said panel in proper alignment with said first and second apertures through said panel of said charger unit depresses said lever flush with the surface of said panel and extends said probe through said first aperture into said cavity of said enclosure, thereby making electrical connection between said electrical power source and said electrical energy storage means within said enclosure.

9. The device of claim 8 wherein the upper surface of said tray contains a concave depression adapted to snugly engage the transverse cross sectional shape of said enclosure when said enclosure is placed downward on said tray.

10. The device of claim 9 wherein said tray contains means for sensing said engagement of said enclosure by said concave depression and providing an electrical signal indicating said engagement.

11. The device of claim 10 wherein said means for sensing comprises a light emitting diode which emits a horizontal beam across a diagonal of said depression, and a photo-detector whose optical receiving axis is aligned with the optical transmission axis of said light emitting diode, said photo-detector being positioned on the opposite side of said diagonal.

12. The apparatus of claim 1 further comprising an enclosure containing each of the elements of said electronic dice game except said means for establishing an external magnetic field.u

* * * * *